United States Patent [19]

Schilling

[11] Patent Number: 4,809,763

[45] Date of Patent: Mar. 7, 1989

[54] METHOD OF AND APPARATUS FOR PRODUCING MOLDS AND MOLD SECTIONS AND CORES

[75] Inventor: Herbert Schilling, Erftstadt, Fed. Rep. of Germany

[73] Assignee: Eisenwerk Brühl GmbH, Brühl, Fed. Rep. of Germany

[21] Appl. No.: 162,404

[22] PCT Filed: May 27, 1987

[86] PCT No.: PCT/EP87/00277

§ 371 Date: Feb. 3, 1988

§ 102(e) Date: Feb. 3, 1988

[87] PCT Pub. No.: WO87/07543

PCT Pub. Date: Dec. 17, 1987

[30] Foreign Application Priority Data

Jun. 4, 1986 [DE] Fed. Rep. of Germany ..... 3618703

[51] Int. Cl.[4] ..... B22C 9/10

[52] U.S. Cl. ..... 164/28; 164/29; 164/137; 164/186; 164/228; 164/339

[58] Field of Search ..... 164/28, 27, 29, 137, 164/186, 228, 339

[56] References Cited

U.S. PATENT DOCUMENTS

| | | | |
|---|---|---|---|
| 3,327,767 | 6/1967 | Wallwork | 164/28 X |
| 3,572,418 | 3/1971 | Keller et al. | 164/28 |
| 4,079,774 | 3/1978 | Gunnergaard et al. | 164/28 |
| 4,278,123 | 7/1981 | Goss et al. | 164/28 |
| 4,694,883 | 9/1987 | Haiduk | 164/228 X |

*Primary Examiner*—Nicholas P. Godici
*Assistant Examiner*—J. Reed Batten, Jr.
*Attorney, Agent, or Firm*—Spencer & Frank

[57] ABSTRACT

In a method of producing cores for foundry purposes, with the cores being composed of at least two core sections and being firmly joined with one another, the individual core sections are molded separately in a core mold composed of at least two mold sections. At the end of a molding process for the individual mold sections, their core mold is opened in such a manner that the core section remains connected with a mold section. Then the individual core sections to be joined, together with their mold sections, are moved into an assembly position and are joined together by defined relative movements of the mold sections with respect to one another. After the joining process, the one mold section is released first and then the assembled core is ejected from the other mold section.

16 Claims, 4 Drawing Sheets

METHOD OF AND APPARATUS FOR PRODUCING MOLDS AND MOLD SECTIONS AND CORES

BACKGROUND OF THE INVENTION

1. Field of the Invention

The invention relates to a method of producing molds and mold sections for foundry purposes, particularly for the production of cores composed of at least two core sections which are fixed to one another, with the individual core sections being separately molded in a core box composed of at least two box parts.

The term "core" in the sense of this application is understood to mean, on the one hand, composite mold sections which are placed into a casting mold and solve problems with respect to cavities, undercuts and similar concerns in casting mold design, i.e. foundry cores in the conventional sense. On the other hand, the term includes, within the scope of the present invention, also the casting mold itself which is composed of a plurality of sections made of the same molding material and according to the same method as foundry cores. Depending on the shape of the casting to be produced, the inner walls and/or also the outer walls of the casting may be delimited by the assembled "core sections".

2. Discussion of the Prior Art

In the past, composite cores were produced in that the individual core sections were molded, removed from the core mold and intermediately stored, whereupon they were joined by hand. The firm connection between the individual core sections was here produced either by screwing or a friction lock in the form of conical pins and conical recesses disposed at the core sections, with an appropriate compression pressure having to be applied. The thus firmly joined, complete core was then placed onto a conveying means, for example a pallet and, for certain cases of use, was blackened by immersion in an appropriate device, in which case the excess immersion fluid was centrifuged away. This method is very time-consuming and additionally has the drawback that the depositing and picking up of individual core sections between the individual manufacturing stages subjects the core sections to unnecessary stresses which lead to breakouts or also to abrasion which results in deviations from set dimensions, displacement of the core sections with respect to one another, crevices or the like. As a consequence, the castings produced with such cores require subsequent work at considerable expenditures for labor, with displacement or splitting, in particular, producing burrs at the casting which must be removed at least in those regions of the casting which are not subjected to subsequent mechanical processing phases. For complicated casting molds, such as, for example, engine blocks for motor-vehicle engines, some of these regions are very difficult to reach so that the removal of casting burrs is very labor intensive.

DE-A Nos. 1,253,415 and DE-A1 3,200,193 disclose apparatus in which two mold sections are molded in one core mold box and the subsequent joining of the two core halves is effected by a relative movement of the two core box halves still in the core molding machine. The core box halves here remain firmly connected with one another so that guiding and centering of the core sections to be joined is effected by way of the core box halves themselves. The drawback of these prior art methods is that only two-part cores and thus practically only foundry cores in the conventional sense can be produced. Complicated, multi-part casting molds cannot be produced in this manner.

SUMMARY OF THE INVENTION

It is now the object of the present invention, in a method of producing molds and mold sections for foundry purposes, particularly for the production of cores composed of a plurality of core sections which are to be firmly connected with one another, with the individual core sections each being molded separately in a core box composed of at least two box parts and, at the conclusion of the molding process for the individual core sections, their core boxes being opened in such a manner that the core section remains connected with a box part, whereupon the core sections to be joined are joined by a defined movement of the box parts relative to one another and after joining, the core sections are initially released from the one box part and then the assembled core is ejected from the other box part, to provide an improvement such that more complicated cores composed of a plurality of core sections can be produced and assembled by machine while realizing greater trueness to dimension and better molding accuracy.

This is accomplished with the method according to the invention in that the molding process for the individual mold sections is performed in molding machines which operate independently of one another and that the box part (bottom section box) for a core section defined as the bottom core section remains connected with that core section as its supporting and centering element and participates in all subsequent joining operations, with all other core sections being assembled by joining them on top of the bottom core section whereupon the complete core is ejected from the bottom section box which serves as the supporting element.

The particular advantage of the method according to the invention is that, at the end of the molding process, the individual core sections are not released completely from their core boxes but remain connected with a box part and are joined with one another by relative movement of the box parts holding them. Since now the geometric association required for joining and the resulting relative movement between the individual core sections to be joined is effected by the corresponding alignment and movement of the box parts with respect to one another, the joining process can be performed with great precision since the core sections, each held in its own box part, have a spatial orientation that could never again be realized after complete unmolding. The fact is here taken advantage of that, in a molding process in which the binder for the core sand is activated not by temperature but by chemical-catalytic processes, the box parts of the individual molding machines have a practically unchanging temperature during their entire period of operation and thus no deviations from the dimensions of the mold sections relative to one another can occur due to thermal expansion. Thus it is possible to provide the individual box parts with guide and centering faces that associate them with one another in a manner that the accuracy of the joining process can be produced by the box parts themselves. Since the geometric orientation in space can now be given in the respective box parts by appropriate centering means, it is possible, even with complicated joining movements, to perform the joining by machine, for example, by the superposition of translatory and rotational movements at one or both box parts. In particular, it is possible to release at least one of the box parts holding a core section from the core molding machine and send it to undergo the individual joining operations in succession since each one of the box parts is self-centering. Since, after the joining operation and release from their box part, these joined core sections are now connected with the bottom core section and are thus supported by the bottom section box the geometric orientation in space continues to remain unchanged so that subsequent joining operations performed by machine can also be performed with precision. Only if all joining operations have been completed and all core sections are joined completely, is the finished core ejected from the bottom section box and can be removed, for example, by grippers to be brought to further processing stations, for example, to be immersed for blackening.

Particularly for cores which, as described above, form a casting mold and are generally composed of more than two core sections, so that several joining operations must be performed in succession, it is of advantage to utilize the fact that the bottom section box permits the retention of a defined and thus reproducible geometric orientation, so that the individual core sections can be joined with great precision. The associated contact faces of the individual core sections are then not subjected to any wear during the transporting processes so that their faces and their edges have a precise relationship to one another which prevents the formation of crevices or displaced edges. Such cores composed of a plurality of core sections can also be firmly connected to one another in the most varied ways, depending on the geometric configuration of the core and it is possible to employ the most varied connection methods. For example, core section connections may be effected in the same manner by a friction lock, i.e. by way of conical pins at one core section and conical recesses in the other core section, or by adhesive connections or also screw connections. Particularly with a friction lock connection but also with an adhesive connection, the method according to the invention has the advantage that the precisely defined joining movement does not subject the conical pins to unilateral abrasion; rather, the faces forming the friction lock contact one another and are pressed against one another only immediately before contact is established between the core sections. The invention also relates to an apparatus for implementing the method, the apparatus including at least two core molding machines for the production of core sections, with each core molding machine including a core box composed of at least two box parts. According to the invention, the apparatus is configured in such a manner that at least one box part (bottom section box) in at least one core molding machine is in communication with a transporting device which connects the core molding machine with at least one joining station; the joining station is equipped with a centering device for the bottom section box to be transported and with an ejection device for the core section to be joined to the bottom core section. With the aid of the centering device for the bottom core section, the latter is given a precisely defined position in space in which it can then be joined with the other box part containing the core section to be attached. With core sections having a simple configuration, the joining movement may reside in a purely translatory movement so that the joining device can be constituted essentially of a pneumatic system or a hydraulic cylinder. For geometrically more complicated core sections, the joining device should be designed so that at least two translatory movements are superposed and, if necessary, translatory movements and rotary movements can be superposed on one another in order to insert the core section into the core section held in the bottom section box. The apparatus then requires the provision of a plurality of bottom section boxes which should be circulated between the associated molding machine and the joining station or stations so that the individual core molding machines of the apparatus are able to operate essentially in synchronism.

An advantageous feature of the invention provides that the joining device includes holding and centering elements for the bottom section box as well as for the box part for the core section to be joined, with these devices engaging in one another during the relative movement of the two box parts and having such dimensions that the centering elements are in engagement with one another before the core sections are joined. In this way, it is ensured that centering of the box parts relative to one another has already taken place before the core sections to be connected contact one another. The holding and centering elements may be part of the joining device and may center both box parts with respect to one another before the joining movement starts. It is, however, particularly advisable for the holding and centering elements to be disposed directly at the box parts so that, independently of the configuration of the joining device, the box parts to be brought together center themselves. This makes it possible to freely move the bottom section box.

However, a particularly advantageous feature of the invention provides that the joining device is formed by the respective successive core molding machine, with the open, unfilled box part in each case serving as the receptacle for the bottom section box. This has the advantage that the available precision of the core molding machine during opening and closing of the two box parts connected therewith can be utilized simultaneously for the joining operation. The transporting device transports the bottom section box to the open, i.e. unfilled, box part of the core molding machine and is received thereby. The normal closing movement of the core molding machine then brings the bottom section box and its core section, which may already have been joined in the preceding joining operation, toward the other box part of the core molding machine which holds the core section to be attached an joins it with the bottom section. After release of the attached core section from its box part, for example by means of an ejector, the bottom section box is then lowered again by way of a normal opening movement and can be taken up again by the transporting device and freely transported to the next core molding machine which acts as the joining station.

It is advisable to provide the bottom section box with centering elements on the forming side of the mold and on the back side of the mold and to provide the core box halves for the core section to be joined in the core molding machine serving as the joining device with corresponding centering elements on the forming side of the mold. In this way, the box parts center one another so that it is not only the precision of the joining device which is decisive, be it a separate joining device or a core molding device acting as joining device. Another advantage is that with each reworking of the box parts the centering is monitored and can also be reworked. In this connection it is of advantage for the centering elements on one side of the box part to be configured as centering pins and on the other side of the box part as recesses.

A particularly advantageous feature of the invention provides that the centering pin is held in the box part to be longitudinally displaceable against a compression spring element and its free end is given a conically tapered configuration. In this way it is accomplished that during joining of the box parts, the latter are initially centered with respect to one another and only then are the box parts moved relative to one another. This also makes it possible to configure the guide for the centering pin with a high fit quality since due to the preceding centering process the danger of canting no longer exists, particularly since the movement is effected essentially by the core molding machine which is designed for accurate guidance of the box parts. The conical configuration of the free pin end, particularly if, according to a further feature of the invention, the recess for accommodating the centering pin in the box part is given a conically tapering configuration when seen from the opening region, simplifies "threading" of the centering pin in the recess of the other box part, particularly since it is possible to exert slight transverse forces between the two parts practically without any longitudinal movement of the centering pin.

If, according to a further feature, the apparatus is configured in such a manner that the parting plane of the mold boxes of the individual core molding machines is essentially horizontally oriented, with the bottom section box also being transported in this orientation, it is not only ensured that the core packet which is built up in steps on the bottom section box is unable to come loose from the bottom section box even as a result of possible shocks during transport. On the other hand, in cooperation between the weight of the bottom section box to be received by the open box part of a core molding machine and the centering pins, reliable "automatic" locking is realized during the individual motion sequences of the joining operation.

In an apparatus of such configuration it is advisable for the longitudinally displaceable centering pins to be disposed in a downward orientation at the box parts of the core molding machine and at the bottom section boxes. In this way, it is avoided that released molding substance particles can reach the interior of the pin guides. In this connection, it is advisable for the bottom region of the recess to be provided with an orifice going through to the exterior. In this way, it is ensured that no molding substance particles dropping from the core sections can collect in the recesses which are open toward the top.

BRIEF DESCRIPTION OF THE DRAWINGS

The invention will now be described in greater detail with reference to schematic illustrations of an embodiment, wherein.

DESCRIPTION OF THE PREFERRED EMBODIMENTS

Figure 1:
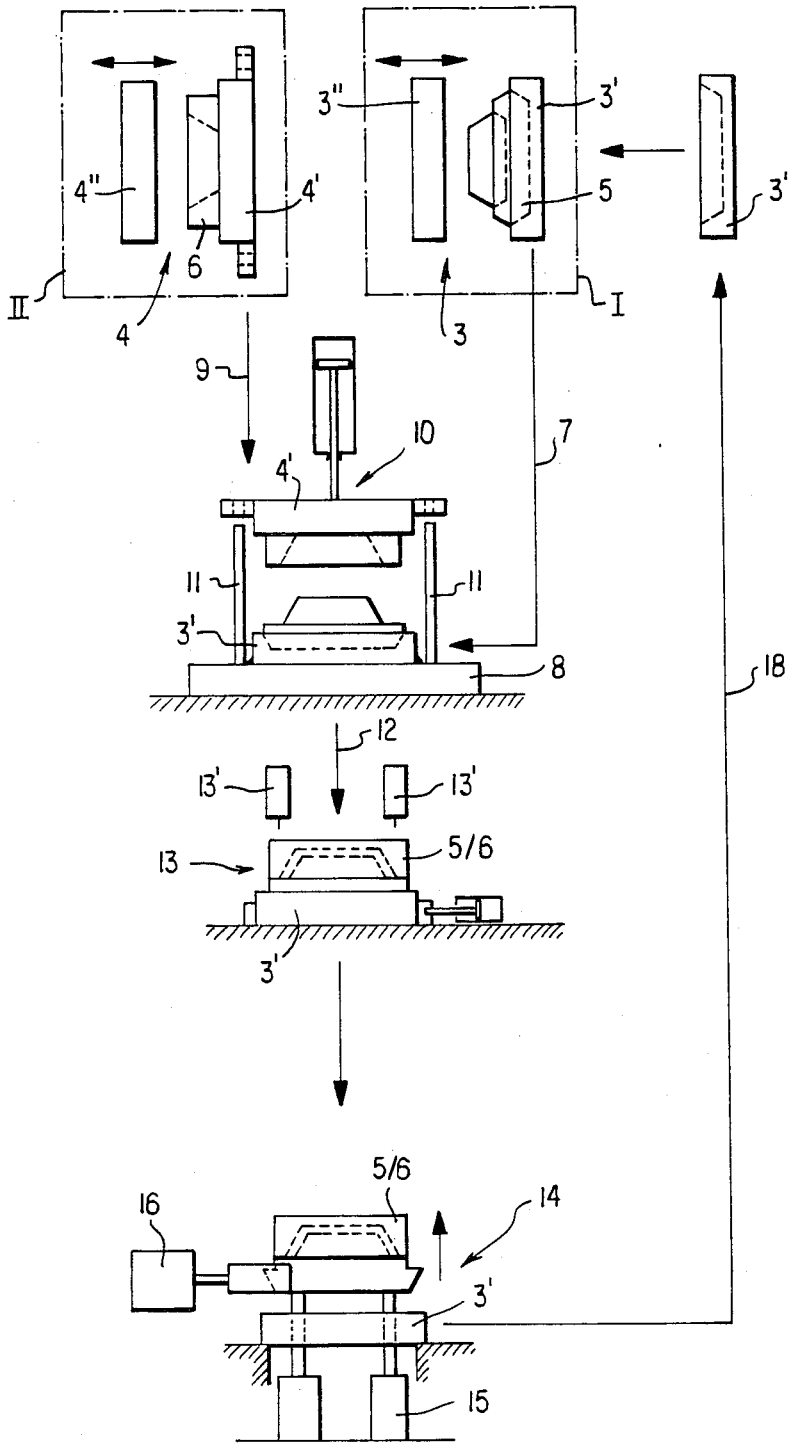
FIG. 1 is the process sequence in the form of a flow diagram.

The process sequence will initially be described in a simplified manner for the example of a two-part core which must be assembled, for example, of two core sections for a casting having interior undercuts. Accordingly, the two required core sections for such a core are produced with the aid of two core molding machines I and II, which are indicated only schematically in the flow diagram of FIG. 1 by their core boxes 3 and 4. The core molding machines are of conventional construction and employ, for example, a core molding process in which the binder is activated by the introduction of a catalytically acting gas into the closed mold filled with a molding substance, for example core sand.

After setting of the molding substance, core boxes 3 and 4 are opened, i.e. box parts 3'' and 4'' are raised so that core sections 5 and 6 remain connected by their adhesion to box parts 3' and 4'.

Now box part 3' is moved into a joining station 8 with the aid of a transporting device 7, which is shown in the flow diagram merely by a bold-face arrow, and is there fixed and centered by means of fixing devices (not shown in detail), for example hydraulically or pneumatically actuatable clamping jaws. In practice, it here depends on the shape of the core section, the orientation of its parting line and its core markers, whether the centering and fixing in joining station 8 is effected in a horizontal orientation, as shown, or in some other orientation, for example, inclined or vertical.

Box part 4' with core section 6 is also moved to joining station 8 by means of a transporting device 9 so that box part 4' is positioned in the joining station precisely perpendicularly above box part 3'. By way of a joining device 10, which may be stationary or may be connected with the movable portion of transporting device 9, box part 4' and core section 6 are then lowered onto box part 3' and core section 5, thus joining together the two core sections. Since, after the joining operation, the joined core continues to be transported together with box part 3', the latter forms the bottom section box. By way of rigid guide elements 11, for example guide rods, guide pins or the like, which are either fixed to the receiving member of joining station 8 or may be fixed to box part 3' serving as the bottom section box, care is now taken that, during lowering of box part 4' with the aid of joining device 10, core section 6 is joined to core section 5 in the accurate geometric orientation. Depending on the shape of the core sections and also of the associated core markers, guide elements 11 may be provided with stops which limit the joining movement in the direction toward the bottom section box. As soon as the joining movement is completed, an ejection mechanism (not shown in detail) of known construction releases the now joined core section 6 from its box part 4' and box part 4' is raised again and returned by way of transporting device 9 to core molding machine II.

The firm connection between the joined core sections may now be effected by a friction lock, for example by conical pins at one core section and corresponding associated conical recesses at the other core section so that during the joining movement simply pressing the pins into the recesses connects the two core sections firmly with one another. With this manner of making the connections, an ejection mechanism of known construction is able to eject the completely joined core from bottom section box 3' immediately after raising of box part 4' and to transport it away. After release of the fixing device, transporting device 7 can move bottom section box 3' back to the core molding machine I and the next molding process can take place.

If, for reasons of size and/or weight and/or the forces acting on the core, a stronger connection must exist during the casting process, the two core sections are fixed to one another in the conventional manner with the aid of special screws. Screwing can be effected, as in the past, still in joining station 8 either manually with pressure operation or by means of electric screw drivers.

Since, however, the core as a whole retains an accurate, reproducible orientation in space before it is ejected by way of bottom section box 3', this process can also be mechanized. Here, again, appropriate screw drivers may be used still in the joining station 8 after removal of box part 4'. However, in order to increase the operating speed of the machine it is advisable to move bottom section box 3' out of joining station 8 by means of an appropriate further transporting device 12 into a "screwing station" 13, where it is fixed and centered by mean of appropriate fixing devices and to then screw the core sections firmly to one another by means of screwing tools 13'.

After the screwing process, the finished core 5/6 is ejected by means of ejectors 15 from bottom section box 3', either while it is still in screwing station 13 or in a subsequently provided transfer station 14, to then be taken up by a gripping element 16 and transported to further production phases via a transporting device 18.

In order for the two core molding machines to be able to operate approximately in synchronism in a processing sequence in which a bottom section box 3' passes through several stations before the finish-joined core is ejected, it is necessary to provide a larger number of bottom section boxes 3' which circulate through the apparatus.

The arrangement and sequence of the individual operating phases of the apparatus described in connection with FIG. 1 is now essentially dependent on the size and shape of the core sections to be joined. It can easily be seen that, for example, a plurality of core molding machines may here be arranged in a star pattern or radially around joining station 8 if, for example, more than two core sections are to be joined.

Depending on the type and duration of the individual joining operations, it may, however, also be advisable to arrange several core molding machines in series and to associate one joining station with each core molding machine, with the bottom section box 3' then passing through each joining station in succession with a further core section being added in each station. In this case, it is then only necessary, in view of the high costs for the box parts which must be produced with great precision, to provide the larger number of bottom section boxes only for one of the core molding machines, namely for the machine which molds the bottom core section. For all other core molding machines, sufficient output can still be realized if the respective box part 4' is moved to the associated joining station after the core box has been opened, the joining operation is performed and then the empty box part 4' is returned to the core molding machine for a new molding process. Particularly for cores composed of more than two core sections, different joining methods can be employed. For example, two core sections may be connected together by gluing or friction lock and then, once a third or fourth core section has been added, the entire packet may be screwed together.

Figure 2:
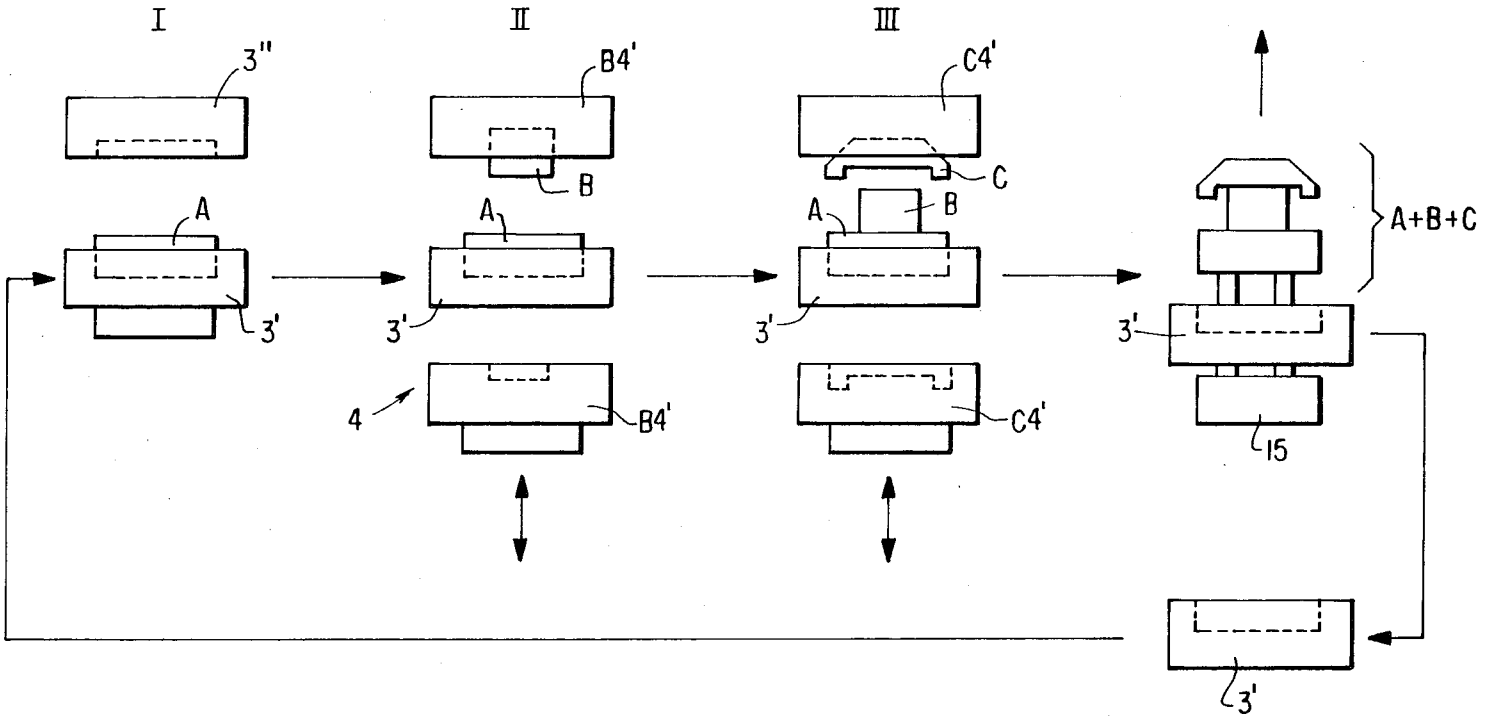
FIG. 2 is a modified process sequence in the form of a flow diagram.

FIG. 2 shows, in the form of a flow diagram, a process sequence modified with respect to FIG. 1 for a core composed of three core sections. The description below will make it obvious that this process sequence is particularly suitable for precise joining of a plurality of core sections to form a core packet. For the sake of simplicity, however, the process sequence will be described only for the example of a core packet composed of three core sections.

The apparatus includes three core molding machines I, II and III in which core sections A, B and C are molded. The core boxes are each formed of box parts 3', 3" of core molding machine I and B4', B4" as well as C4' and C4" of core molding machines II and III, respectively. Core section A forms the bottom core section so that, correspondingly, box part 3' forms the bottom section box which is releasably connected with the core molding machine and can be moved by means of a transporting device 7 (not shown in detail except by bold face arrows) within the apparatus. Box parts B4" and C4" are each fixed to their associated core molding machines II and III, respectively.

Once bottom core section A has been molded in core molding machine I, bottom section box 3' is picked up by the transporting device and moved to core molding machine II. In core molding machine II, core section B has already been molded so that the core box opens and box part B4" is moved downward until bottom section box 3' is able to move into the thus opened core box 4. The core section B to be joined is here held by box part B4'. Now core box 4 is closed so that box part B4" receives bottom section box 3' disposed thereabove in a centered manner and its core section A is moved toward core section B in box part B4' until core section B and core section A are joined in the above-described manner. Then, by way of an ejection mechanism (not shown in detail here) in box part B4', core section B is released from box part B4' so that, when box part B4" is lowered, the now joined partial packet can be moved downward and back until it reaches the transporting position. Then, the transporting device moves bottom section box 3' into the now open box part C4' of core molding machine III in which the core packet is completed in the above-described manner by joining of core section C. Then bottom section box 3' with the now completely joined core packet is brought to an ejector 15 and is thus released from bottom section box 3' and brought to the casting station. The transporting device then returns the now empty bottom section box 3' to core molding machine I. This above-described process sequence shows that several bottom section boxes 3' must be provided for core molding machine I to follow the operating rhythm of the entire apparatus and these boxes are then circulated through the apparatus. In this type of apparatus, the subsequent core molding machines II and III thus additionally also perform the function of a joining station so that the precision given by the core molding machine is also utilized to advantage for the joining operation. Since box parts B4' and B4" as well as C4' and C4" of the subsequent core molding machines II and III are each provided with centering means in order to increase the molding accuracy, this also offers an opportunity for the respective bottom section box 3' to be received in a centered manner by the respective open box part B4" or C4", if the box itself is appropriately equipped with centering means, and to thus perform a self-centering joining operation.

The method and thus also the apparatus described in connection with the flow diagrams of FIGS. 1 and 2 may be modified in such a manner that, for example, for a core composed of four sections, two core sections are joined in one joining operation, as described in FIG. 1, and then one of the partial cores composed of two joined core sections is moved in the same manner with the box part previously used as the bottom section box into a final assembly station where it is joined by way of this bottom section box with the bottom section box of the other core section packet.

Since after opening of the core box, each core section can be positively handled by way of the mold part connected with it, intermediate operations may also be provided in this process sequence for individual ones of the section molds. For example, zones or edges of the core which are particularly endangered during the casting process may be provided with a coating of blackening by means of spraying or painting. In view of the unequivocally defined spatial association by way of the connection with the mold part, this process can also be performed by machine.

Figure 3:
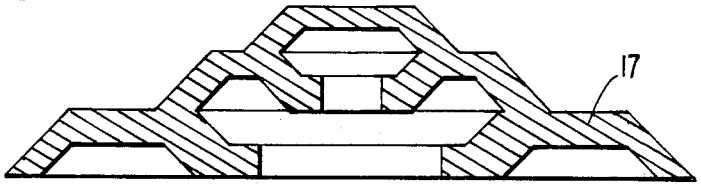
FIG. 3 is a sectional view of a casting.

FIG. 3 is a sectional view of an exemplary embodiment in the form of a rotationally symmetrical, bowl-shaped casting 17 which is provided with a plurality of undercuts. The casting mold required to produce it, including the cores, cannot be produced of one piece but must be assembled of four core sections.

Figure 4A:
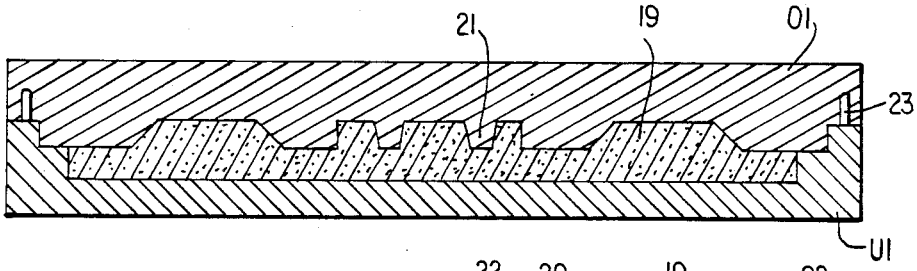
FIGS. 4*a*, 4*b*, 4*c* and 4*d* are views showing is sectional view of the joining of several core sections into a complete casting mold for the production of the casting of FIG. 3.
Figure 4B:
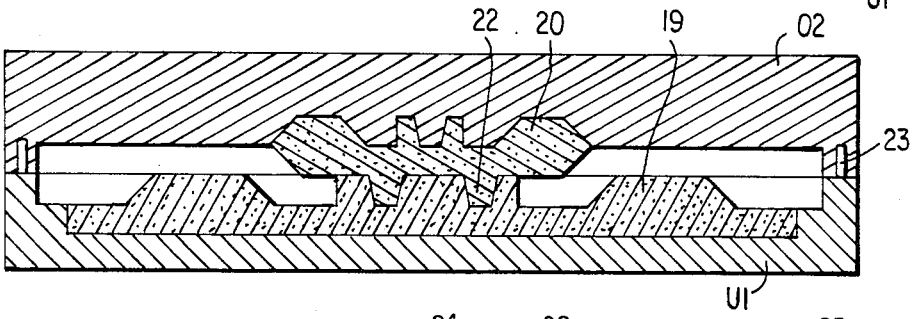

The joining operation is shown in FIGS. 4*a*, 4*b*, 4*c* and 4*d* as four. An apparatus as described in connection with FIG. 2 is used for the production but, instead of three core molding machines, a total of four core molding machines are used here. The sectional view of FIG. 4*a* shows the production of the bottom core section 19 with the aid of a core mold divided into a drag U1 and a cope O1. After opening of the core mold, as described in connection with FIG. 2 for core molding machine I, bottom core section 19 remains in drag U1 which simultaneously constitutes the bottom section box and serves as fixing and centering means in all subsequent joining operations. Bottom section box U1 is now moved to the subsequent core molding machine II and is there geometrically accurately fixed. Thus core section 19 is also geometrically accurately oriented in space.

Figure 4C:
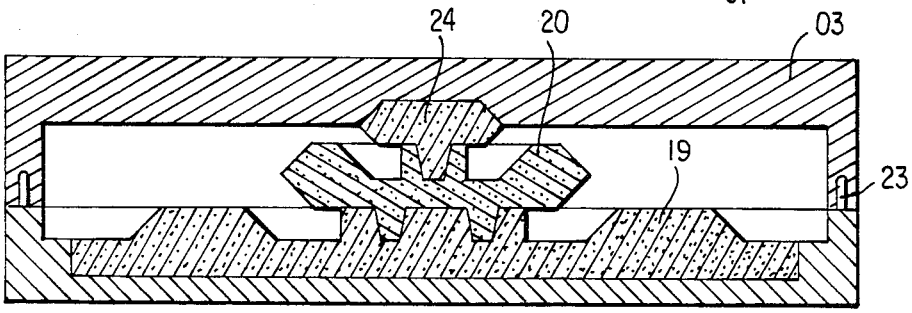
Figure 4D:
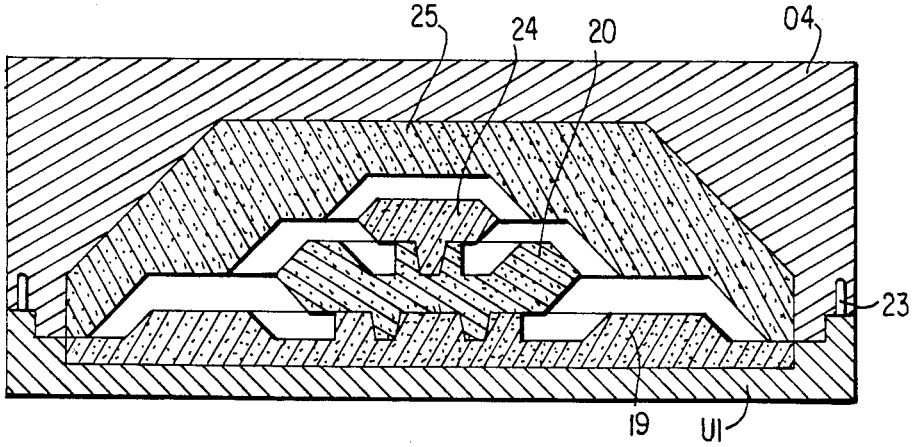

Thereafter, bottom core section 19 is now brought to core section 20 to be joined, which is connected with its mold section O2, and is joined with it, with the pin 22 of core section 20 being inserted into recess 21 in core section 19. However, before core sections 19 and 20 come into contrast with one another, guide pins 23 at bottom section box U1 engage in box part O2 so that, independently of any possible alignment errors in the closing movement of core molding machine II, the two box parts and thus the two mold sections are inserted accurately into one another. Thereafter, as shown in FIGS. 4*c* and 4*d*, core sections 24 and 25 are joined in the same manner, with the connection between the individual cores again being effected by corresponding conical pins. Since the individual core sections must be firmly connected with one another to form the total core, this may be accomplished, for example, by way of an adhesive connection or also by a friction lock connection in the region of the conical pins.

After insertion and release of the last core section 25 from box part O4, an ejection device (not shown) of conventional construction then ejects the complete casting mold from bottom section box U1 so that it can be removed for the further manufacturing process. Bottom section box U1 is then returned, as shown in FIG. 2, by means of an appropriate conveying device to the associated core molding machine I.

The illustrated and described joining operation may also be performed in such a manner that bottom section box U1 is clamped on once and all associated other box parts O2, O3 and O4 are successively brought to one joining station. Or, after every joining operation, bottom section box U1 can be moved to an appropriately configured separate multi-part joining station where it advances by one step so that always a plurality of core sections are being joined simultaneously.

The embodiment described with reference to FIGS. 3 and 4*a*–4*d* shows that particularly the manufacture of complete casting molds, including the cores to be inserted, can actually be performed fully automatically. Instead of the conventional mold boxes with which the casting mold is formed by jolting a wooden pattern into sand, the molding substance employed for the production of the cores can be used to produce the outer mold and this can be done according to the same process. Since the actual core and the outer mold are manufactured of the same molding substance and in the same process, i.e. with the same accuracy and the same strength characteristics, the joining of outer mold and core can also be effected according to the method of the invention. The division of core and outer mold can here be effected in such a manner that during joining in subsequent joining operations, parts of the outer mold and parts of the core are joined, possibly in alternation. In this connection it is even possible to integrate parts actually belonging to the core in corresponding parts of the outer mold and to mold them together with the latter so that, for example, the casting mold will have a layered structure.

Since customarily such cores or casting molds are constructed of sand and it cannot be excluded, even with the above-described, fully mechanized molding and joining method, that abrasion occurs to a slight degree or insufficiently bonded grains of sand come loose, the danger exists that individual grains of sand penetrate into the centering elements and block them unless one is willing to provide additional cleaning devices which automatically clean the guiding and centering elements, for example as shown in FIG. 1, before each joining operation. Particularly for the process sequence described in connection with FIG. 2, in which the individual core molding machines themselves take over the joining operation, it is important for the centering elements to be connected directly with the core box sections. A special embodiment will be described below with reference to a simplified drawing of core molding machine II of FIG. 2. The same parts here are given the same reference numerals.

Figure 5:
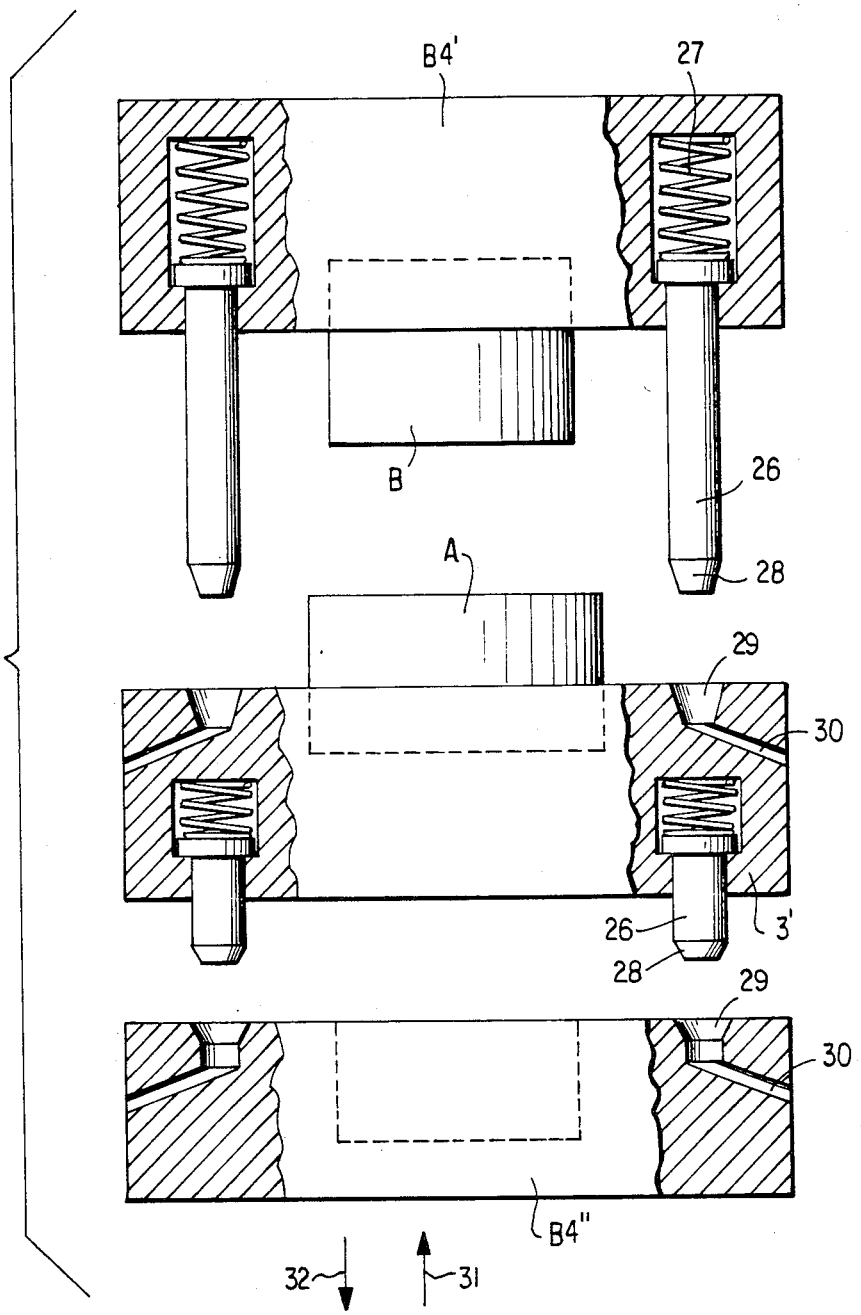
FIG. 5 is an embodiment of a centering element.

As shown in FIG. 5, the forming side of upper box B4′ adjacent core section B is provided with centering pins 26 which are held to be longitudinally displaceable against a compression spring element 27 in box part B4′. Centering pin 26 can here be guided in a high quality fit without play, since molding sand particles are unable to enter into the guide on top. The free end 28 of guide pin 26 is configured to be conically tapered.

On its back side of the mold, movable bottom section box 3′ is likewise provided with centering pins 26 which are longitudinally displaceable against a compression spring element 27 and whose free ends 28 are also given a conical configuration. Centering pins 26 of bottom section box 3' may here be shorter since bottom section box 3' is always placed only onto the open, i.e. empty lower box part B4". The centering pins 26 at the upper box part B4', however, must be made longer since the height of bottom core section A and the height of core section B to be joined as well as a minimum free space for the centering movement to be described in greater detail below must always be available.

Lower box part B4" and bottom section box 3' are provided with conically tapered recesses 29 which are associated with the conically tapered end 28 of the associated centering pins 26. The conically tapered recesses 29 are each provided in their bottom region with an orifice 30 which goes through to the exterior so that molding sand particles dropping into recess 29 are unable to collect in the recess and thus proper operation is ensured over a long period of operation.

The bottom section box 3' supplied by the transporting device is now initially received by the lower box part B4" which moves in the closing direction (arrow 31), with conical ends 28 of centering pins 26 initially engaging in recesses 29 and accurately centering bottom section box 3'. During the further course of the movement, centering pins 26 are pressed in against the force of compression spring element 27 until bottom section box 3' lies on the parting face of box part B4" and, in the further course of the closing movement, is lifted away from the transporting device and guided toward upper box part B4'. Here again, the conical ends 28 of centering pins 26 of box part B4' initially engage in conical recesses 29 on the forming side of mold of bottom section box 3' so that accurate centering is provided here before the two core sections A and B to be joined come in contact at all. In the further course of the closing movement, centering pins 26 are then pressed in, with the closing movement being continued until the two core sections A and B are joined in the intended manner. Thereafter, movement in the opening direction (arrow 32) is initiated so that bottom section box 3' and core section B, which is now firmly joined with core section A, is lowered, possibly upon actuation of an ejection mechanism (not shown in detail here) provided at box part B4".

As soon as the transporting device is reached, further lowering causes bottom section box 3' to come loose from box part B4" so that bottom section box 3' can be moved freely to the next joining operation.

I claim:

1. A method for producing molds and mold sections for foundry purposes and for producing cores composed of a plurality of core sections which are to be firmly connected with one another, comprising the steps of:

separately molding individual core sections in independently operating molding machines containing respective core boxes having at least two box parts, one of the core boxes includes a bottom core section which remains connected with a bottom core section box part and serves as a supporting and centering element;

opening each respective core box so that the respective core section remains connected with a respective box part;

passing the bottom core section and the bottom core section box part to a subsequent core molding machine;

joining the bottom core section with the respective core section of the subsequent core molding machine so that the bottom core section and the respective core section can be moved on the bottom core section box part to the next core molding machine;

passing the bottom core section to each subsequent core molding machine and joining the respective core section of each subsequent core molding machine on the bottom core section until a completed core is formed; and ejecting the completed core from the bottom core section box part.

2. A method as defined in claim 1, wherein in said step of passing and joining, the bottom core section box part is successively moved to the next respectively open core box containing the next respective core section to be joined and to perform the joining step, the bottom core section box part is moved toward the respective core section and takes and releases the respective core section from its respective box part.

3. A method as defined in claim 2, wherein in said step of passing and joining, with the respective core box open, the respective box part for the respective core section to be joined receives the bottom core section box part and said step of joining is performed by a closing movement of the respective core box followed by an opening movement of the respective core box whereupon the bottom core box part and the core sections that have been joined are now ready for further transport to the next respective core box.

4. A method as defined in claim 1, wherein the respective core sections are firmly connected together after said step of joining.

5. A method as defined in claim 1, further comprising the step of firmly connecting the core sections together after the completed core has been assembled.

6. A method as defined in claim 5, wherein said step of firmly connecting the core sections together is accomplished by screwing.

7. An apparatus for producing molds and mold sections for foundry purposes and for the production of cores composed of a plurality of core sections which are to be firmly connected to one another, comprising:

at least two core molding machines for producing core sections, said core molding machines each being equipped with a core box composed of at least two box parts, wherein one box part of one of the core boxes is a bottom core section box part that carries a bottom core section;

at least one joining station provided with holding and centering elements for said bottom core section box part;

a transporting device for transporting said bottom core section box part from one of said core molding machines to said joining station; and an ejection device for ejecting said bottom core section and a respective core section which have been joined in said joining station.

8. An apparatus as defined in claim 7, wherein said holding and centering elements for said bottom core section box part also hold and center another box part which contains a respective core section to be joined, said holding and centering elements engage one another during relative movement of said bottom core section box part and said another box part and are dimensioned so that said holding and centering elements are in engagement with one another before said bottom core section and the respective core section are joined together.

9. An apparatus as defined in claim 7, wherein said bottom core section is joined to a respective core section in a subsequent core molding machine, the respective core section being located in one box part with another box part being a receptacle for said bottom core section box part.

10. An apparatus as defined in claim 7, wherein said bottom core section box part has a forming side and a back side with said forming side and said back side of said bottom core section box part including means for centering said bottom core section box part in each subsequent core molding machine.

11. An apparatus as defined in claim 10, wherein on one of said sides of said bottom core section box part said means for centering comprise centering pins and on the other of said sides of said bottom core section box part said means for centering comprise recesses formed on said bottom core section box part.

12. An apparatus as defined in claim 11, wherein said centering pins are longitudinally displaceable against a compression spring element and said centering pins include a free end which has a portion which is conically tapered.

13. An apparatus as defined in claim 11, wherein said recesses include a beginning portion which is conically tapered.

14. An apparatus as defined in claim 13, wherein said recesses include a bottom region that is provided with an orifice that extends to the exterior of said bottom core section box part.

15. An apparatus as defined in claim 7, wherein said bottom core box part includes a means for ejecting a complete core.

16. An apparatus as defined in claim 7, wherein said box parts of said molding machines have a parting plane with an essentially horizontal orientation.

* * * * *